US005080605A

United States Patent [19]

Mitra

[11] Patent Number: 5,080,605

[45] Date of Patent: Jan. 14, 1992

[54] INSULATION DISPLACEMENT CONTACT

[75] Inventor: Niranjan K. Mitra, Eindhaven, Netherlands

[73] Assignee: E. I. Du Pont de Nemours and Company, Wilmington, Del.

[21] Appl. No.: 606,965

[22] Filed: Oct. 31, 1990

[30] Foreign Application Priority Data

Nov. 7, 1989 [NL] Netherlands ..... 8902750

[51] Int. Cl.[5] ..... H01R 4/24

[52] U.S. Cl. ..... 439/405; 439/395

[58] Field of Search ..... 439/389–407

[56] References Cited

U.S. PATENT DOCUMENTS

| | | | |
|---|---|---|---|
| 3,854,114 | 12/1974 | Kloth et al. | 339/97 R |
| 3,910,671 | 10/1975 | Townsend | 439/397 |
| 4,023,883 | 5/1977 | Raposa et al. | 439/402 |
| 4,060,302 | 11/1977 | Saligny | 339/97 R |
| 4,106,838 | 8/1978 | Jayne et al. | 339/99 R |
| 4,113,338 | 9/1978 | Spaulding | 439/406 |
| 4,118,096 | 10/1978 | Takahashi | 339/99 R |
| 4,262,984 | 4/1981 | Takahashi | 339/97 R |
| 4,296,988 | 10/1981 | Warner | 439/398 |

*Primary Examiner*—David L. Pirlot

[57] ABSTRACT

An insulation displacement contact for insulation displacement contacting of an insulated electrical conductor disposed in a cable. Each contact comprises two flat sheet parts abutting against each other, obtained by folding over a flat blank of metal and provided with projecting tongues bounding an aperture for receiving the cable and displacing the insulation thereof. The ends of the tongues lying away from the aperture are folded over essentially at right angles to the plane of the flat sheet parts, in order to form an H-shape.

6 Claims, 2 Drawing Sheets

INSULATION DISPLACEMENT CONTACT

BACKGROUND OF THE INVENTION

The present invention relates to an electrical connector and in particular to electrical connectors having terminals with insulation displacement contacts.

Insulation displacement contacts are well known in the art. One example is described in U.S. Pat. No. 4,118,096, which shows a contact with adjacent tongues which are staggered slightly relative to each other. A double contact is provided through the use of four tongues. If the contact between the cable and the tongues is lost with one set of tongues, there is still possible contact with the other set of tongues. In order to make the tongues sufficiently rigid, both as regards bending in a direction moving the tongues apart and as regards bending of the tongues in the direction of the central axis of the cable, the tongues are made relatively wide. This does, however, mean that limits are set for the distance or pitch between adjacent conductors of a flat cable since the conductors may be touched only by the contacts intended for them, which is determined by the width of the tongues.

U.S. Pat. No. 4,262,984 disclosed another insulation displacement contact which comprises a single flat sheet part provided with projecting tongues which are folded over at their end so that a U-shape is obtained.

SUMMARY OF THE INVENTION

The object of the present invention is to avoid the above disadvantages and provide an insulation displacement contact which can electrically contact conductors spaced at very small pitch distances. This object is achieved by providing an insulation displacement contact having tongues with sides edges facing away from the aperture which are folded at approximately right angles to the plane of the flat sheet parts in order to form an H-shape. Folding the side edges of the tongues make it possible to restrict greatly the width of each tongue while still achieving the strength needed for displacing or piercing the cable insulation, thus ensuring good electrical contact with the conductor and making certain that a displacement is provided between conductor and insulating material.

The rigidity of the tongues is now partially achieved by the folded-over side edges of the tongues which lie in a plane at right angles to the crosswidth direction in a connector with multiple contacts. As a result, it is possible to reduce significantly the pitch between adjacent conductors of a flat cable.

According to an advantageous embodiment, the flat sheet parts are directly connected to each other by means of a 180° fold. In other words, the H-shape extends only over the part of the tongues near the insertion aperture for the conductor. This is the part under the greatest load.

According to another advantageous embodiment, the flat sheet parts are connected to each other by means of the tongues, which are connected to each other by means of a connecting part which rests against the tongues. In this way, a particularly rigid construction, in which the flange of the H-shape is made double at the connecting part, is achieved.

In order to be able to pierce through the insulation better near the conductor, the folded-over ends of the tongues are designed in a preferred embodiment so that they taper towards the insertion aperture for the conductor.

The invention also relates to an assembly comprising a number of adjacent insulation displacement contacts of the type described above which are staggered relative to each other.

The invention will be explained in greater detail below with reference to an example of an embodiment shown in the drawing in which:

DETAILED DESCRIPTION OF THE EMBODIMENTS

Figure 1:
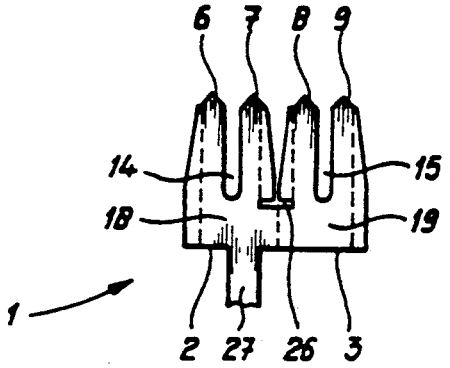
FIG. 1 shows a flat sheet from which the insulation displacement contact according to the invention is made by folding.

FIG. 1 shows a part of a flat metal blank from which the insulation displacement contact terminal according to the invention is obtained by folding. The flat blank is indicated in its entirety by 1, and comprises two flat sheet parts 2 and 3, provided with projecting tongues 6, 7, 8 and 9. An insertion aperture 14 is bounded by the tongues 6 and 7, while another insertion aperture 15 is bounded by the tongues 8 and 9. The ends of the tongues are bevelled, in order to center the conductor and facilitate the piercing of the insulation. The sides of each of the tongues facing away from the apertures 14 and 15 are also bevelled. The adjacent ends of tongues 7 and 8 are separated from the flat sheet parts 2 and 3 by a cut-out 26. The fold lines along which flat blank 1 is to be folded are indicated by dashed lines.

Figure 2:
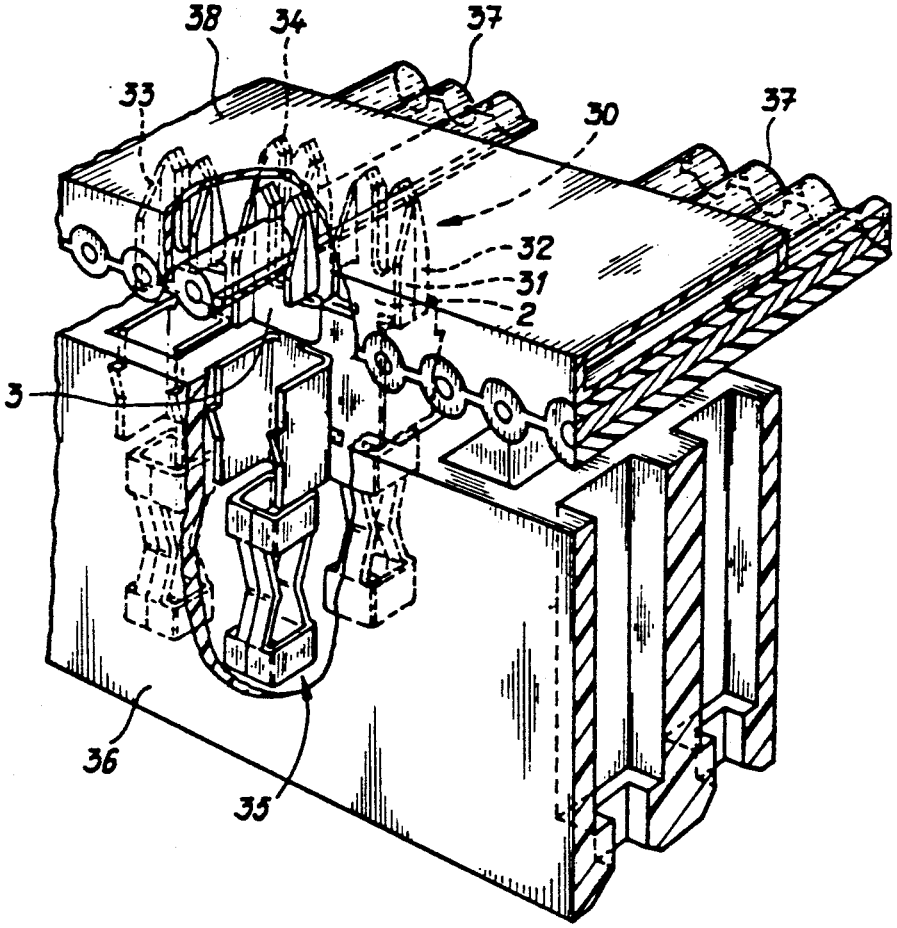
FIG. 2 shows a side view of a number of insulation displacement contacts according to FIG. 1 made by folding.

A neck 27 forms a contact strip, which is connected to a contact at the other end of the terminal. This other contact may be any of those well known in the art. In FIG. 2, one such other contact is shown at 35 and is the subject of U.S. Pat. No. 4,721,484 owned by the assignee of the present application. This contact is sold by the Du Pont Company under its trademark "Micro-Tri-Beam".

Folding the flat sheet parts 2 and 3 along the center fold line through 180° brings them against each other so each part abuts superimposed over the other. Thereafter or earlier, or at the same time, the outer sides of each of the tongues not adjacent to the apertures 14, 15 are folded over through essentially 90° along their respective fold lines, resulting in the insulation displacement contact as shown in FIG. 2 in its entirety by 30. Sections 18 and 19 are the portions of flat sheet parts 2 and 3, respectively, which remain in abuting contact with one another. It can be seen in FIG. 2 that the ends which have been folded over form four flanges 31, 32, 33 and 34. It can also be seen from FIG. 2 that various insulation displacement contacts according to the invention are disposed so that they are staggered relative to each other in order to make optimum use of space.

Through use of the flanged parts 31, 32, 33 and 34, the conductors 38 of a cable 37 can be placed closer together, at a smaller pitch, without risk of inadvertent electrical contact between adjacent tongues and a conductor arising when the cable conductor are being inserted. The flanges provide an excellent guide for the conductors as well as optimum stripping of the cable insulation with sufficient strength in the tongues. The tapering of the flanges 31, 32, 33 and 34 towards the insertion aperture ensures that the insulation is easily pierced. Since the flanges 31, 32, 33 and 34 form an obstacle for the cable, the cable will be automatically positioned there with the part with the least resistance. This provides a centering effect due to the fact that the relatively weak insulation part between the conductors comes to rest there.

The insulation displacement contacts 31 shown in FIG. 2 are each provided at their other end with a Micro-Tri-Beam contact 35, but it will be understood that any contact known in the art can be used. All the contacts are incorporated in an insulation block 36. Cable 37 is aligned over contact 31 and pressed down by a top connector insulation block 38 to electrically connect each cable conductor with its respective contact. An extremely small pitch distance between the contact apertures is thereby achieved in an extremely simple manner without further measures.

Figure 3:
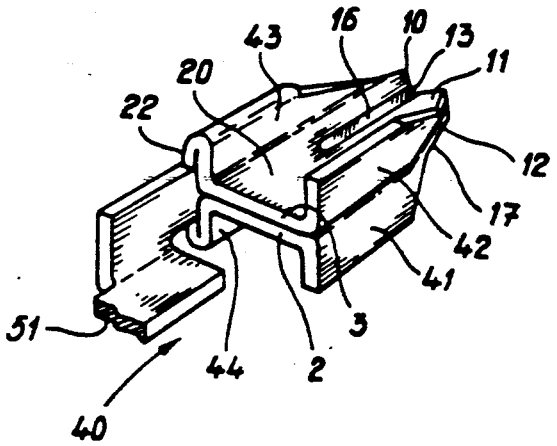
FIG. 3 shows a detail of a further embodiment of the insulation displacement contact according to the invention.
Figure 4:
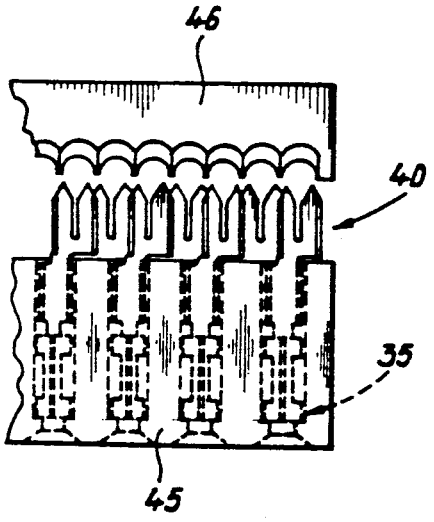
FIG. 4 shows a number of insulation displacement contacts according to FIG. 3 disposed in a contact or connector block.

FIGS. 3 and 4 show a further embodiment of the insulation displacement contact of invention, indicated in its entirety by 40. The connection to neck 51 is not shown in any further detail. In FIG. 3, the contact is shown folded up. As in the case of the embodiment of FIGS. 1 and 2, the contact 40 is made by folding over a flat blank. Tongues 10, 11, 12 and 13 are provided here with flanges 41, 42, 43 and 44. Unlike the embodiment of FIGS. 1 and 2, the flanges 43 and 44 are connected by means of a connecting part 22 with cross-bar 20 connecting these flanges to flanges 41 and 42, the contact has an H-shaped cross-section which has particularly great strength.

FIG. 4 shows schematically an insulation block 45 containing various insulation displacement contacts of the type shown in FIG. 3. Reference number 46 shows the top part of a contact insulation block, which has to be fitted on the insulation block 45 after insertion of the flat cable (not shown). Here again, the insulation displacement contacts 40 are arranged in a staggered manner.

It will be apparent to one skilled in the art that the invention principles disclosed herein can be practiced by other than the embodiments described, which are presented for purposes of illustration rather than limitation, and the present invention is limited only by the claims which follow.

I claim:

1. An insulation displacement contact for piercing insulation of a cable to electrically contact one of the conductors in said cable comprising two flat metal sheet parts superimposed over one another and disposed in abutting contact with each other in a pair of parallel planes, each flat sheet part having an aperture for receiving the cable conductor, said aperture of each flat sheet part being aligned with one another, and each flat sheet part having a pair of projecting tongues bounding and defining said aperture, a side edge of each tongue facing away from said aperture being tapered along at least a portion of its length to narrow toward its free end, said tapered side of each tongue being folded at right angles to extend away from each other substantially perpendicular to the plane of each flat sheet part, thereby forming four tapered flanges, a pair at each side of the superimposed flat sheet parts extending in opposite directions.

2. An insulation displacement contact according to claim 1 wherein the free end of each tongue is bevelled.

3. An insulation displacement contact according to claim 1 wherein the flat sheet parts are formed integrally from a flat metal blank and are superimposed over one another by folding approximately 180° at a fold line in a portion connecting the flat sheet parts to each other.

4. An insulation displacement contact according to claim 1 wherein the cross-section of the contact is approximately H-shaped with the flanges forming the legs and the abutting flat sheet parts forming the cross-bar of the H-shape.

5. An insulation displacement contact according to claim 1 wherein one pair of said oppositely extending flanges are connected via a portion of said flat metal blank which extends toward the other end of the contact.

6. A connector assembly having a plurality of electrical terminals disposed in a housing of insulating material, said electrical terminals being arranged in staggered relationship, one end of each said terminal having an insulation displacement contact according to claim 1, the other end of each terminal terminating in another contact, said connector assembly adapted to receive and pierce a cable to electrically contact one of the conductors of the cable with a respective insulation displacement contact.

* * * * *